United States Patent [19]

Bowers

[11] Patent Number: 4,943,056

[45] Date of Patent: Jul. 24, 1990

[54] PING PONG TABLE ACCESSORY APPARATUS

[76] Inventor: Kevin R. Bowers, 1476 Beverly Dr., Arcata, Calif. 95521

[21] Appl. No.: 315,641

[22] Filed: Feb. 27, 1989

[51] Int. Cl.[5] ..... A63B 69/00

[52] U.S. Cl. ..... 273/30

[58] Field of Search ..... 273/30, 29 A, 29 R, 273/26 A, 410, 411, 127 D

[56] References Cited

U.S. PATENT DOCUMENTS

| | | | |
|---|---|---|---|
| 1,567,384 | 12/1925 | Rectenwald | 273/26 A |
| 2,174,884 | 10/1939 | Kachel | 273/30 |
| 2,711,899 | 6/1955 | Forsyth | 273/30 |
| 3,088,735 | 5/1963 | Clark | 273/30 |
| 3,408,071 | 10/1968 | Lundy | 273/26 A |
| 3,826,144 | 9/1974 | Mahoney | 273/26 A |
| 4,134,585 | 1/1979 | Semon | 273/30 |

*Primary Examiner*—Theatrice Brown

*Attorney, Agent, or Firm*—Henderson & Sturm

[57] ABSTRACT

A ping pong table accessory apparatus (10) for use with a ping pong table (100); wherein, the apparatus (10) includes a rotatable ball rebound backboard unit (12) and a plurality of pivoted sideboard units (13) suspended from a movable support unit; whereby, the backboard unit (12) and the sideboard units (13) may be disposed at selcted angles and orientations relative to one another and to the ping pong table.

4 Claims, 1 Drawing Sheet

FIG. 1.
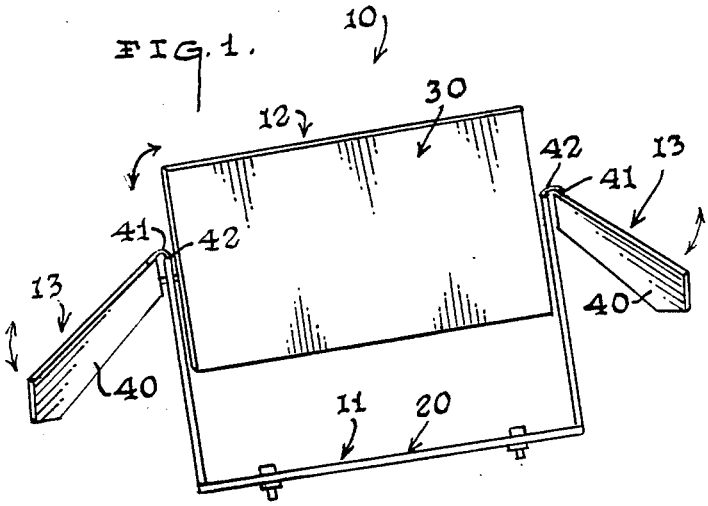
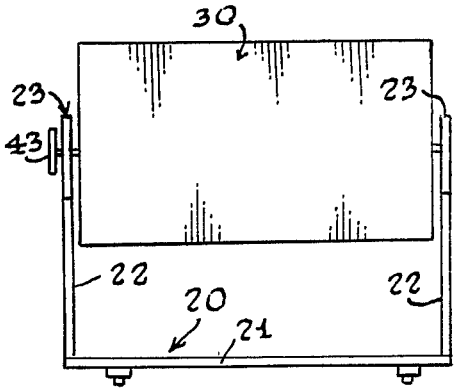
FIG. 2.
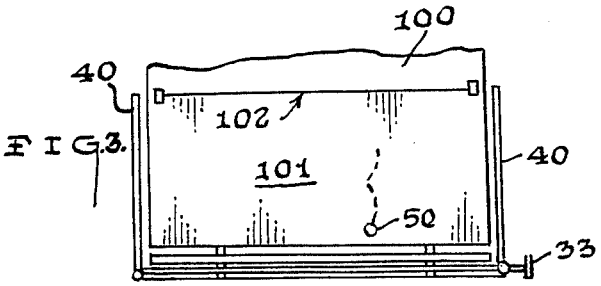
FIG. 3.
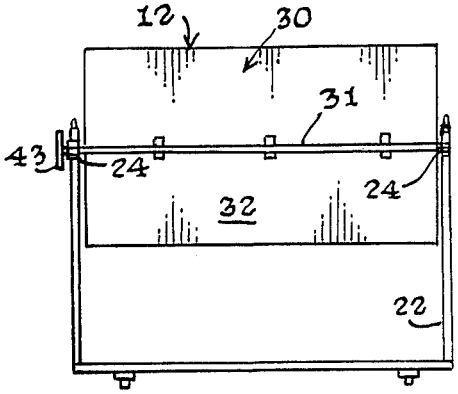
FIG. 4.
FIG. 5.
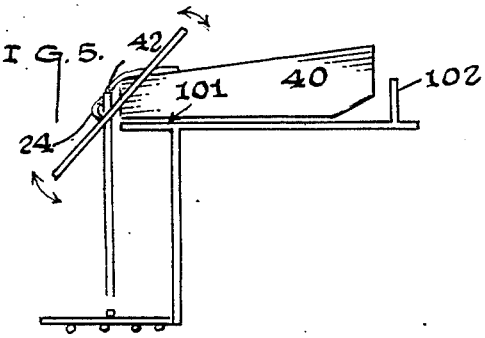
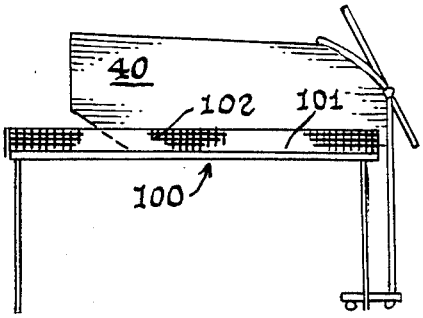
FIG. 6.
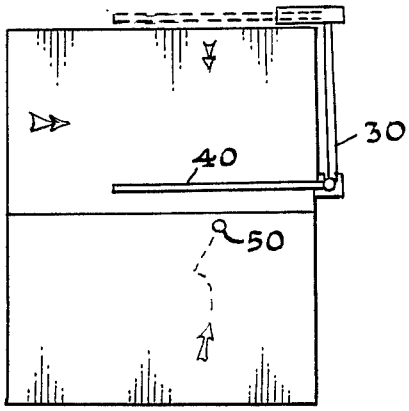
FIG. 7.

PING PONG TABLE ACCESSORY APPARATUS

TECHNICAL FIELD

The present invention relates generally to rebound practice boards for ping pong tables, and more specifically to articulated and/or adjustable rebound practice boards for ping pong tables.

BACKGROUND OF THE INVENTION

This invention was the subject matter of Document Disclosure Program Registration No. 185,377 which was filed in the U.S. Patent and Trademark Office on Feb. 1, 1988.

As can be seen by reference to the following U.S. Pat. No's: 3,088,735; 4,134,585; 2,174,884; and, 2,711,899 the prior art is replete with myriad and diverse rebound-/backstop devices for ping pong tables wherein a player can practice returning serves.

While all of the aforementioned devices are more than adequate for the basic purpose and function for which they have been specifically designed, these prior art constructions are also deficient in a number of salient respects.

To begin with, virtually all of the aforementioned prior art constructions are either deployed at a fixed angle relative to the top of the ping pong table or otherwise physically attached to a portion of the table surface.

In addition, most of the prior art constructions will only provide a single primary backstop surface for one or more players to practice rebounds, which effectively limits the usable playing surface available for practice.

Furthermore, none of the prior art constructions envision an arrangement wherein two or more players can propel balls either directly at one another towards an intervening backstop surface; or in the alternative allow two or more players to propel ping pong balls in a direction of flight that is perpendicular to one another and which employs two independent backstop surfaces that are disposed generally perpendicular to one another with the added capability of being oriented in different vertical, horizontal, and transverse planes relative to one another.

As a consequence of the foregoing situation there has existed a longstanding need among ping pong aficionandos for a backstop practice device that possesses all of the aforementioned improved characteristics of the present invention.

SUMMARY OF THE INVENTION

Briefly stated, the ping pong table accessory that forms the basis of the present invention comprises in general: a wheeled support unit; a backboard unit pivotally secured to the wheeled support unit; and, a pair of sideboard units rotatably suspended on the wheeled support unit on opposite sides of the backboard unit.

The wheeled support unit comprises a wheeled platform member having a pair of upwardly projecting support arms wherein the upper ends of the support arms are provided with means for movably supporting and suspending both the backboard unit and the pair of sideboard units, as will be described in greater detail further on in the specification.

The backboard unit comprises a generally rectangular backboard member and an axle member secured to the back of the backboard member and is pivotably supported on the upper portion of the support arms.

In addition, each of the pair of sideboard units comprise a generally elongated trapezoidal rebound member suspended from a rod member having one end rotatably supported in the top portion of one of the support arms, whereby, the sideboard units may be rotated around a vertical axis while the backboard unit may be pivoted around a horizontal axis.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is an isolated perspective view of the ping pong table accessory of this invention;

FIG. 2 is an isolated front plan view of the accessory;

FIG. 3 is a top plan view of the accessory in one orientation relative to a ping pong table;

FIG. 4 is an isolated rear plan view of the accessory;

FIG. 5 is a cross-sectional side view of the accessory in the orientation depicted in FIG. 3;

FIG. 6 is a side plan view of the accessory in another orientation relative to a ping pong table; and, FIG. 7 is a top plan view of the orientation depicted in FIG. 6.

BEST MODE FOR CARRYING OUT THE INVENTION

As can be seen by reference to the drawings and in particular to FIG. 1, the ping pong table accessory apparatus that forms the basis of the present invention is designated generally by reference numeral (10). The apparatus (10) comprises in general: a support unit (11); a backboard unit (12); and, a pair of sideboard units (13). These units will now be described in seriatim fashion.

As can best be seen by reference to FIGS. 2, 4 and 5, the support unit (11) comprises a generally U-shaped support framework (20) including a wheeled base member (21) having a pair of upwardly projecting support arms (22) formed on opposite ends of the base member (21); wherein, each of the support arms (22) have a hollow tubular recess (23) formed at their upper ends In addition, each of the support arms (22) are further provided with opposed bracket elements (24) proximate their upper ends.

As shown in FIGS. 2 and 4, the backboard unit (12) comprises in general: an elongated flat rectangular backboard member (30) having an elongated axle member (31) disposed along the longitudinal axis and operatively secured to the rear surface (32) of the backboard member (30); wherein, the ends of the elongated axle member (31) project beyond the sides of the backboard member (30) and are pivotally and frictionally engaged in the opposed bracket members (24) on the support arms (22).

In addition, at least one end of the axle member (31) is provided with an enlarged control knob (33), whereby, the angular disposition of the backboard member (30) relative to the support arms (22) may be incrementally varied in a well recognized manner due to the relatively tight frictional engagement between the ends of the axle member (31) and the support arm brackets (24).

Turning now to FIGS. 1, 5 and 6, it can be seen that each of the sideboard units (13) comprise a generally elongated trapezoidal rebound board member (40) suspended from an elongated L-shaped rod member (41) wherein the downwardly depending leg (42) of the rod member (41) is dimensioned to be rotatably received in the recess (23) formed in the support arms (22); such that the sideboard units (13) may be rotated both towards and away from one another as well as the backboard unit (12).

As mentioned earlier on in the specification the apparatus (10) of this invention is intended to be used in a variety of orientations relative to a ping pong table (100) having a playing surface (101) bisected by a net (102). In one of these orientations depicted in FIGS. 3 and 5, the apparatus (10) is positioned on one end of the table (100) with the sideboard units (13) aligned with the sides of the table (100) and the backboard unit (12) disposed at a selected angle relative to the horizontal playing surface. In this orientation the player would hit a ping pong ball over the net (102) and the ball (50) would bound off the table surface (101) striking the backboard unit (12) and rebounding back over the net.

In another orientation depicted in FIGS. 6 and 7, the apparatus (10) would be positioned along one side of the table (100) wherein the backboard unit (11) would be aligned with the side of the table (100) and at least one of the sideboard units (13) would be disposed in close proximity and parallel to the net (102). In this orientation as indicated by the directional arrows in FIG. 7, two players can simultaneously practice hitting rebound shots either on opposite sides of one of the sideboard units (13); or, in the alternative one player can practice hitting rebound shots off the sideboard unit (13) closest to the net, while another player can simultaneously practice hitting rebounds over the selectively angled backboard unit.

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A ping pong table accessory apparatus for use with a ping pong table having a horizontal playing surface and net bisecting the horizontal playing surface wherein the apparatus comprises:

a support unit including a pair of upwardly projecting spaced apart support arms, each arm having a bracket element adjacent its upper end and recess in its upper end;

a ball rebound backboard unit comprising an elongated generally rectangular backboard member having horizontally spaced sides and front and rear surfaces, said backboard being operatively secured to a horizontally extending axle member said axle member having ends projecting beyond the sides of said backboard member; said ends of the axle member being received in a respective bracket element on said support arms for pivotally supporting said backboard between said support arms; and a pair of sideboard units, means engaging said recess for pivotally connecting each of said sideboards to the upper end of a said support arm for movement relative to said backboard.

2. The accessory apparatus as in claim 1 wherein said axle member is disposed on said rear surface and parallel to the longitudinal axis of said backboard member.

3. The accessory apparatus as in claim 2 wherein at least one end of said axle member is provided with an enlarged control knob for selectively holding said backboard member of a plurality of angles relative to said support arms.

4. The accessory apparatus as in claim 1 wherein each of the sideboard units comprises:

an elongated generally trapezoidal rebound board member suspended from said means engaging said recess, said means engaging said recess is comprised of an elongated rod member having one of its ends received in a respective said recess.

* * * * *